United States Patent [19]

Bahr

[11] 4,208,276

[45] Jun. 17, 1980

[54] FLOTATION PLANT

[75] Inventor: Albert Bahr, Clausthal-Zellerfeld, Fed. Rep. of Germany

[73] Assignee: Bergwerksverband, GmbH, Essen-Kray, Fed. Rep. of Germany

[21] Appl. No.: 6,896

[22] Filed: Jan. 26, 1979

Related U.S. Application Data

[63] Continuation of Ser. No. 814,297, Jul. 11, 1977, abandoned.

[30] Foreign Application Priority Data

Jul. 13, 1976 [DE] Fed. Rep. of Germany ..... 2631392

[51] Int. Cl.[2] ..... B03D 1/14

[52] U.S. Cl. ..... 209/168; 209/210

[58] Field of Search ..... 209/168, 170, 210, 211, 209/143, 155, 162–165; 210/221 R, 221 P

[56] References Cited

U.S. PATENT DOCUMENTS

| | | | |
|---|---|---|---|
| 3,747,757 | 7/1973 | Kalthoff et al. | 209/170 X |
| 3,759,385 | 9/1973 | Pouillon | 209/168 X |
| 3,807,557 | 4/1974 | Miller | 209/166 |
| 3,842,004 | 10/1974 | Nagahama | 209/170 X |

FOREIGN PATENT DOCUMENTS

| | | | |
|---|---|---|---|
| 1175621 | 8/1964 | Fed. Rep. of Germany | 209/168 |
| 636327 | 3/1962 | Italy | 209/210 |

*Primary Examiner*—Ralph J. Hill

*Attorney, Agent, or Firm*—Remy J. VanOphem

[57] ABSTRACT

The invention is concerned with an improved flotation plant in which gassed solid particles can be removed from a carrying liquid stream by a separating means. The invention proposes curving the path along which the gassed stream passes upstream of the separating means to facilitate the separation of the gassed and ungassed components.

16 Claims, 4 Drawing Figures

FLOTATION PLANT

This is a continuation of application Ser. No. 814,297, filed July 11, 1977, now abandoned.

BACKGROUND OF THE INVENTION

The invention relates to a flotation plant, particularly, but not exclusively, for coal separating equipment, in which a liquid stream containing solid particles to be floated and other solid particles not to be floated is gassed to form gas bubble/solid particle complexes with the solid particles to be floated, and in which the gassing stream is divided to separate the solid particles which are to be floated from those which are not.

The invention is of particular use in the flotation of very small particles from pulpy streams. It can thus be used to good effect for separating out foreign matter from liquids which contain the foreign matter in very small concentrations; this problem arises mainly in the purification of waste water.

These application possibilities for the invention derive from the construction of the flotation plant. A spatial separation can be provided between a conditioning plant for the stream and the place where the gas bubbles are added to the solid particles to be floated, and between the gassing appliance provided for this purpose and the formation of froth and the separation of the froth formed. In this way the mechanical and hydromechanical conditions which prevail at any given time in the separate stages of such a plant can be used to the optimum effect for the treatment process concerned. This means that in the gassing appliance, conditions are created under which the attachment of the solid particles to the gas bubbles and the generation of contact forces which exceed the repulsing forces are achieved. These conditions are created by the use of reagents or appropriate gases which bind with the solid particles to be floated but not with the solid particles to remain in solution. In the subsequent treatment stages, conditions different from these can be created, whereby amongst other things it can be ensured that the de-foaming of the gas bubble—solid matter complexes can be carried out without dangerous break-down forces arising.

DESCRIPTION OF THE PRIOR ART

A plant with the characteristics indicated in the introduction is already known from German Patent Publication No. 2 420 482. Downstream of the gassing appliance a separating tank is provided, into which the pulp enters, loaded with the gas bubble/solid matter complexes formed earlier. In this tank the formation of froth and with it the separation of the said complexes takes place. For this purpose the tank has a shape which widens out towards the top. Due to the laws of flow, the flow speed is therefore transformed into pressure, which amongst other things leads to the desired suppression of turbulence in the flow of pulp and therefore favors the formation of a froth which is strongly enriched with the gas bubble/solid matter complexes.

In plants of this type it is certainly not possible to achieve the separation of the floating gas bubble/solid particle complexes from the non-floating particles beyond the natural forces of bouyancy.

This is achieved in another plant, also already known from German Patent Application No. 1 175 621, in which the separation of the froth is carried out with the aid of a cyclone since in such apparatus centrifugal forces act on the particles to be floated.

In any case, it has been found that in this type of cyclone, or in appliances constructed on the principle of such apparatus, the expected rapid and efficient separation of particles has not been achieved, since the gassed fluid or pulp flows for its part from the inlet nozzle or supply pipe into a container with a larger cross section. This results in a reduction of the flow speed, but also simultaneously in greater stresses on the gas bubble/-solid particle complexes and is thus less efficient. In addition, in the rotational field flow, sheer layers develop which have a speed that decreases from the axis of rotation outwards in the radial direction. Even a reversal of the direction of rotation can arise from certain outer rotational areas. At the same time there is a reversal of the transportation in the direction of the axis of rotation. This flow behavior subjects the gas bubble/-solid matter complexes to considerable stresses, which results in their destruction. The invention is based on the task of improving that apparatus in a flotation plant with the advantages indicated in which the separation of the froth takes place, in such a way that an immediate separation of the froth is achieved.

SUMMARY OF THE INVENTION

According to the invention a flotation plant to which is fed a liquid stream containing both solid particles to be floated and those not to be floated comprises gassing means for introducing gas into the stream to form bubble/particle complexes with at least some of the solid particles to be floated and means to separate the said complexes from the stream. It is characterised in that downstream of the gassing means the plant provides a curved separating stretch having a length which is chosen relative to the curve and the speed of the flowing stream. While maintaining the said complexes, a boundary layer is formed between the gas bubbles and the bubble/particle complexes on one hand and any remaining solid constituents of the stream on the other hand. At the downstream end of the separating stretch, a separating means such as a septum divides the boundary layer to create a partial stream containing the said complexes. The gassing means may include a sintered metal diffusing nozzle and, in contrast to flotation plants heretofore known, the gas can be introduced into said separating stretch in which said previously determined flow characteristics prevail rather than into a separating apparatus with a larger cross-section. The curvature of the separating stretch is adapted to the flow speed in such a way that the adhesion force between the gas bubbles and the solid particles remains greater than the resultant of the forces acting on these complexes in the rotational field. The length of the separating stretch is in turn dependent on both the curvature and the flow speed.

At the end of the separating stretch, the said separating layer forms, in which, for example, a separating blade or septum is arranged to separate the gas-free stream or fluid from the frothy component and this separation is desirably carried out immediately. The two parts of the stream can then be led away separately or processed further in any way required. A flotation plant in accordance with the invention has the advantage that it utilizes enhanced separating forces by making use of centrifugal forces. On the other hand, destruction of the previously formed bubble/particle complexes along the separating stretch is avoided. In this way a very rapid and effective separation of the particles being floated out of the pulp or emulsion can be achieved.

Preferably, the plant is designed to ensure that the flow speed occurring in the vicinity of the gassing means is maintained over the separating stretch. For this purpose the separating stretch can have a cross section which is tailored to make this speed maintenance possible. The cross section can be rectangular or oval. An oval cross section makes separation of the said phases easier.

A substantially circular separating stretch has also proven effective, especially since the desired curvature can be obtained in a simple form of construction. The separating stretch should encompass in its curved section more than half (e.g. about three-quarters) of a circle to a full circle. It is also possible for the curved section of the separating stretch to be formed in a spiral shape.

BRIEF DESCRIPTION OF THE DRAWINGS

The invention will be described in greater detail, by way of example with reference to a construction example of a flotation plant, which is shown schematically in the drawings.

DESCRIPTION OF THE PREFERRED EMBODIMENT

Figure 1:
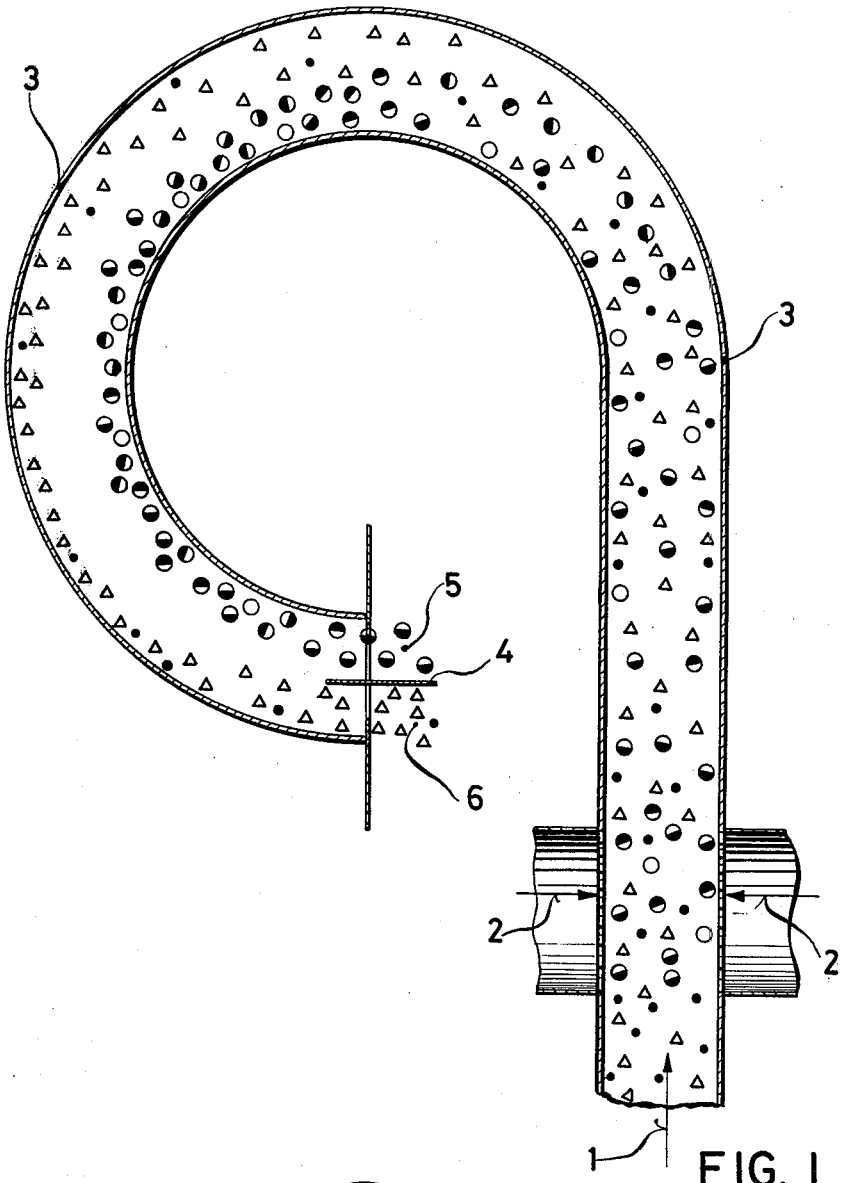
FIG. 1 is a schematic of the invention showing the curred separating stretch.
Figure 2:
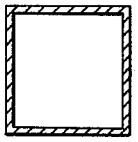
FIG. 2 is a cross sectional view of the separating stretch according to another embodiment of the invention with a rectangular cross section.
Figure 3:
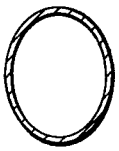
FIG. 3 is a cross sectional view of the separating stretch according to further embodiment of the invention with an oval cross section.
Figure 4:
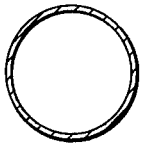
FIG. 4 is a cross sectional view of the separating stretch according to a further embodiment of the invention with a circular cross section.

A solid matter/water suspension or a liquid/liquid dispersion is supplied from a conditioning plant (not shown), in the direction of the arrow 1. At a gassing section of the plant the suspension or dispersion is gassed. The devices used for this gassing are not shown in detail, merely being indicated by the arrow 2. For example, a compressed air supply pipe can be connected to a sintered metal diffuser or other inlet nozzle device which projects into the liquid stream and introduces the gas in the form of small bubbles indicated by open circles in the drawing. The particles which are not to be floated are shown as triangles in the drawing, and black dots indicate the particles to be floated.

Due to the gassing process, gas bubbles become attached to the particles to be floated and form a bubble/-particle complex which is shown in the drawing by a circle which is half filled in. Following a short section of the flow path downstream of the gassing section, which section is shown as a straight run in the drawing, the gassed suspension or dispersion arrives at a separating stretch 3 which is of tubular construction and corresponds, as far as its cross section is concerned, to the previously described parts of the plant. Due to the curvature of the separating stretch 3 and the flow speed prevailing in the separating stretch, centrifugal forces are exerted on the particles in suspension or dispersion. These centrifugal forces have the effect of carrying towards the outside of the curve the heavier, non-floating particles as well as the small particles to be floated which have not formed a complex with the gas bubbles. The lighter particles, i.e. particularly small gas bubbles and the bubble/particle complexes, remain on the inner circumference of the curved separating stretch, so that at the downstream end of the separating stretch 3, a pronounced boundary layer is formed.

A separating blade or septum 4 projects into this boundary layer, separating the gassy froth phase 5 from the ungassed liquid/solid suspension phase which is designated 6.

After separation, the two phases 5 and 6, are led away separately and may be processed further in any desired way.

The separating stretch 3 shown in the drawing is three quarters of the arc of a circle (whereas at least half a circle would normally be used). The stretch 3 can be a circular curve with a changing radius and/or in spiral form. The tube defining the stretch 3 can have rectangular (e.g. square) or oval cross section.

The flotation plant shown can be used as part of coal separation equipment or in water purification processes.

What is claimed is:

1. A flotation plant comprising:

tubular flow means having a first inlet and an outlet, and adapted to receive a liquid stream containing a plurality of first solid particles to be floated and a plurality of second solid particles not to be floated, said flow means further having a uniform cross section configuration and at least one curved tubular separating stretch interposed said first inlet and said outlet;

at least one second inlet mounted to said flow means downstream of said first inlet, said at least one second inlet being adapted to receive gases upstream of said separating stretch, wherein bubble/-particle complexes are formed, which complexes comprise bubbles of said gases and said first solid particles; and a septum mounted integral said outlet such that said first solid particles associate with bubbles of said gases and form complexes in said stream, said complexes form a boundary layer to be separated on one side of said septum, and said stream containing said second particles form a boundary layer to be separated on the other side of said septum.

2. A plant according to claim 1, wherein said separating stretch further comprises means to maintain the liquid velocity downstream of said separating section proximate the liquid velocity upstream of said separating section.

3. A plant according to claim 1, wherein said separating stretch defines a tube in the form of a circular arc.

4. A plant according to claim 3, wherein the tube defining said separating stretch has a rectangular cross section.

5. A plant according to claim 3, wherein the tube defining said separating stretch encompasses more than half of a circle with its circular arc.

6. A plant according to claim 3, wherein the tube defining said separating stretch has an oval cross section.

7. A plant according to claim 3, wherein the tube defining said separating stretch has a circular cross section.

8. A plant according to claim 1 for coal processing, wherein both said first particles and said second particles are mineral particles.

9. A method of separating first solid particles to be floated from a liquid stream containing said first particles and additionally containing second solid particles not to be floated, said method comprising the steps of:

(a) flowing said liquid stream in a conduit having a uniform cross section configuration;

(b) injecting a gas into said liquid stream in said conduit;

(c) passing the combination of said liquid stream and said injected gas through a curved stretch of conduit whereby bubble/particle complexes are formed by association of bubbles of said gas with said first particles whereupon a boundary layer of said complexes forms in said liquid stream; and (d) separating said boundary layer from said liquid stream.

10. A method according to claim 9, wherein the step of passing the combination of said liquid stream and said injected gas through a curved stretch of conduit further comprises maintaining the velocity of said stream about the same as the velocity upstream of said curved section.

11. A method according to claim 9, wherein said curved stretch of conduit comprises a tube defining a circular arc.

12. A method according to claim 11, wherein said curved stretch of conduit has a rectangular cross section.

13. A method according to claim 11, wherein said curved stretch of conduit has an oval cross section.

14. A method according to claim 11, wherein said curved stretch of conduit has a circular cross section.

15. A method according to claim 11, wherein said circular arc comprises more than half a circle.

16. A method according to claim 9 for coal processing, wherein both said first solid particles and second solid particles are mineral particles.

* * * * *

UNITED STATES PATENT AND TRADEMARK OFFICE

CERTIFICATE OF CORRECTION

PATENT NO. : 4,208,276
DATED : June 17, 1980
INVENTOR(S) : Albert Bahr

It is certified that error appears in the above-identified patent and that said Letters Patent are hereby corrected as shown below:

Column 1, after the sub-title "Background of The Invention", next line insert therefore ----Field of the Invention----.

Signed and Sealed this

*Eighth* Day of *December 1981*

[SEAL]

*Attest:*

GERALD J. MOSSINGHOFF

*Attesting Officer*

*Commissioner of Patents and Trademarks*